US008690375B2

(12) United States Patent
Bobbin et al.

(10) Patent No.: US 8,690,375 B2
(45) **Date of Patent: *Apr. 8, 2014**

(54) POWER CORD MOUNTED ELECTRONIC MODULE FOR PORTABLE LAMP

(75) Inventors: Joseph Bobbin, Nanticoke, PA (US); John Devaney, Mountain Top, PA (US); Mark Dirsa, Shaverton, PA (US)

(73) Assignee: Koehler-Bright Star, Inc., Hanover Township, PA (US)

( * ) Notice: Subject to any disclaimer, the term of this patent is extended or adjusted under 35 U.S.C. 154(b) by 641 days.

This patent is subject to a terminal disclaimer.

(21) Appl. No.: 12/351,618

(22) Filed: Jan. 9, 2009

(65) Prior Publication Data

US 2009/0180279 A1 Jul. 16, 2009

Related U.S. Application Data

(60) Provisional application No. 61/020,518, filed on Jan. 11, 2008.

(51) Int. Cl.

| | |
|---|---|
| ***F21V 21/084*** | (2006.01) |
| ***F21V 25/12*** | (2006.01) |
| ***F21V 21/00*** | (2006.01) |
| ***F21L 23/00*** | (2006.01) |
| ***F21L 4/04*** | (2006.01) |

(52) U.S. Cl.

USPC ..... 362/106; 362/164; 362/198; 362/258; 362/387; 362/407

(58) Field of Classification Search

USPC ..... 362/106, 164, 165, 198, 105, 258, 387, 362/407

See application file for complete search history.

(56) References Cited

U.S. PATENT DOCUMENTS

| | | | | |
|---|---|---|---|---|
| 2,473,394 | A * | 6/1949 | Scott | 340/321 |
| 3,315,263 | A | 4/1967 | Lefevre | |
| 4,263,588 | A * | 4/1981 | Gautier | 340/632 |
| 4,634,936 | A * | 1/1987 | Gentry et al. | 315/307 |
| 4,793,007 | A * | 12/1988 | Barnett | 2/422 |
| 5,558,428 | A * | 9/1996 | Lehrer et al. | 362/105 |
| 6,339,709 | B1 * | 1/2002 | Gladwin et al. | 455/115.1 |
| 7,715,983 | B2 * | 5/2010 | Barrus et al. | 702/2 |

(Continued)

FOREIGN PATENT DOCUMENTS

| | | |
|---|---|---|
| EP | 0291438 | 11/1988 |
| GB | 2254528 | 10/1992 |
| WO | WO 2007/000686 A2 | 1/2007 |

OTHER PUBLICATIONS

English Language Abstract of EP 0291438 published on Nov. 17, 1988.

*Primary Examiner* — David J Makiya

(74) *Attorney, Agent, or Firm* — R. Blake Johnston; DLA Piper LLP US

(57) ABSTRACT

A cap lamp system features a battery pack, a cap lamp housing containing a cap lamp bulb and a power cord connected between the battery pack and the cap lamp housing. The power cord provides power to the cap lamp bulb from the battery pack. An electronic module includes a housing defining a chamber and electronic circuitry is positioned within the chamber of the housing. The electronic module is positioned in circuit with the power cord. The electronic module may receives power from the battery pack and the electronic circuitry of the electronic module may includes a battery that powers the module.

40 Claims, 3 Drawing Sheets

(56) References Cited

U.S. PATENT DOCUMENTS 7,843,348 B2 * 11/2010 Hayford et al. ..... 340/572.8
2003/0016532 A1 * 1/2003 Reed ..... 362/198
2003/0137421 A1 * 7/2003 Herkenrath et al. ..... 340/573.1
2005/0174753 A1 * 8/2005 Cao et al. ..... 362/106
2008/0137589 A1 * 6/2008 Barrett ..... 370/327

* cited by examiner

POWER CORD MOUNTED ELECTRONIC MODULE FOR PORTABLE LAMP

CLAIM OF PRIORITY

This application claims priority from U.S. Provisional Patent Application Ser. No. 61/020,518, filed Jan. 11, 2008, currently pending.

FIELD OF THE INVENTION

The present invention relates to portable lamps such as cap lamps and other portable light sources and, more particularly, to an electronic module that is mounted on a power cord running between a battery pack and a cap lamp or other portable lighting source.

BACKGROUND

Mining cap lamps are typically mounted on hard hats worm by miners to provide illumination in underground mine shafts. Such cap lamps are well known in the mining equipment industry and provide illumination while the miner's hands remain free to perform tasks. A cap lamp typically receives power from a battery power pack secured to the user's waist. An electrical power cord delivers power from the power pack to the lamp on the helmet.

Modern day mines often include a miner tracking system so that the location of miners may be tracked for safety purposes. Such systems often include sensors positioned throughout the mine shafts. A miner wears a radio frequency identification (RFID) tag which broadcasts a signal including the identify of the miner wearing the RFID tag. When the miner passes a miner tracking system sensor, the sensor receives the signal from the RFID tag. The sensors communicate with a central computer which tracks the location of miners wearing the RFID tags based on which sensors have received signals from the miners' RFID tags.

The RFID tags must receive electrical power to operate. Traditionally, wires have been soldered to the battery terminals of the cap lamp power pack and to the RFID tags so that the RFID tags receive power from the battery of the cap lamp power pack. A problem with such an arrangement, however, is that such modifications are time consuming and inconvenient. In addition, and more importantly, the quality of the soldered connections is often inconsistent which leads to reliability issues, especially in the harsh mining environment. The exposed wires of such a power takeoff are also exposed which makes them even more vulnerable to damage.

Furthermore, additional devices or modules that are powered by electricity may be useful if carried by a worker in a mine or other harsh environment. Such devices include, but are not limited to, communication devices, gas sensors and dust sensors.

A need therefore exists for a system or device whereby electronic modules such as RFID tags, communication devices, gas sensors, dust sensors other electronic devices may be securely and safely mounted to miners, rescue workers or other individuals.

DETAILED DESCRIPTION OF EMBODIMENTS

While the invention is described below in terms of use with a battery, cap lamp and helmet for mining, it is to be understood that it may be applied to other types of portable lighting and head gear.

Figure 1:
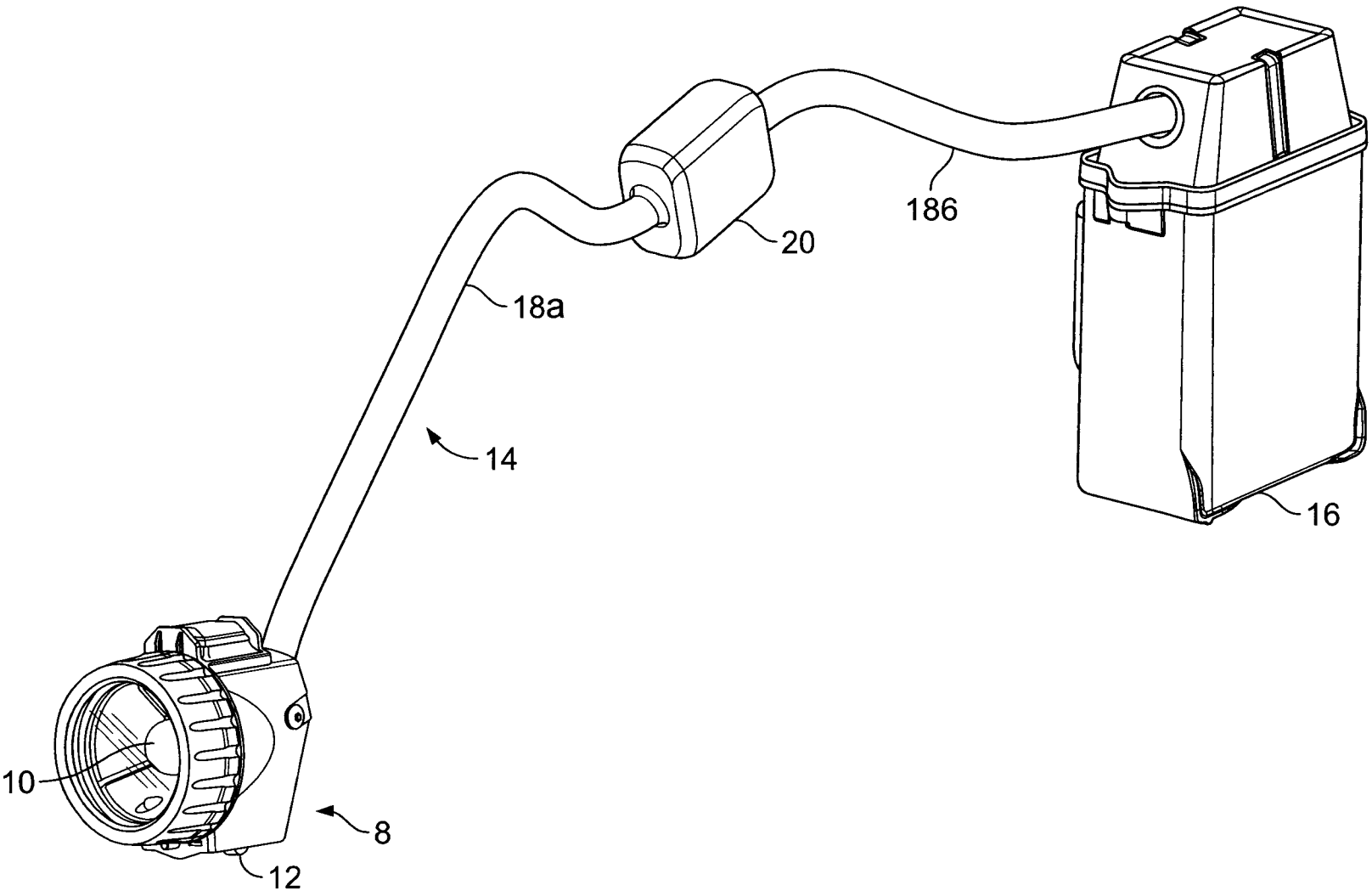
FIG. 1 is a perspective view of a cap lamp system including an embodiment of the electronic module of the present invention.

A cap lamp is indicated in general at 8 in FIG. 1. As is illustrated, for example, in U.S. Pat. No. 4,481,458 to Lane, the cap lamp may be mounted on a helmet of the type used in mining. The cap lamp includes a bulb 10 positioned within a housing 12. As an example only, the cap lamp may be a model Mark V cap lamp sold by Koehler-Bright Star, Inc. of Hanover Township, Pa., who is assignee of the present application. The cap lamp 8 is typically mounted to a front panel of the helmet by a clip or other fastener positioned on the back side of the cap lamp (not shown in FIG. 1). As a result, the cap lamp may be removed from the helmet for recharging or servicing.

The cap lamp 8 receives power via a power cord, indicated in general at 14, that provides power to the cap lamp from a battery pack 16. The battery pack is typically worn strapped to the waist of the miner or in another location. As an example only, the battery pack may be a model Li-16 battery pack sold by sold by Koehler-Bright Star, Inc. of Hanover Township, Pa., who is assignee of the present application.

Figure 2:
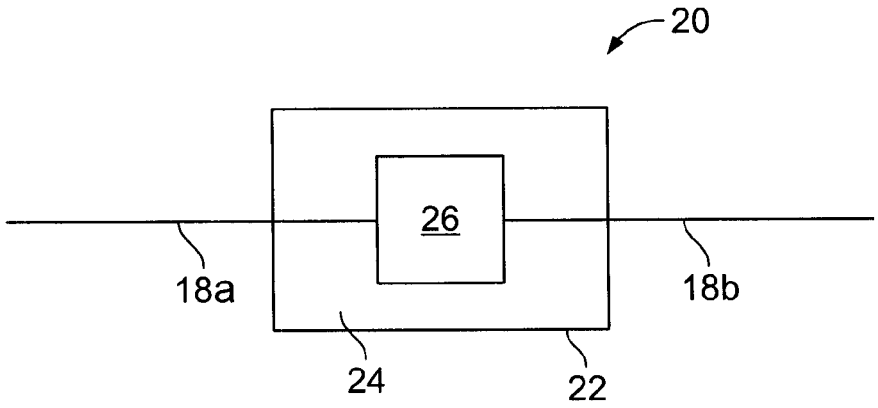
FIG. 2 is a schematic of the electronic module of FIG. 1 and portions of the power cord.

As is illustrated in FIGS. 1 and 2, the power cord 14 features two segments or portions 18*a* and 18*b*. As illustrated in FIGS. 1 and 2, an electronic module 20 is positioned in circuit with the segments 18*a* and 18*b* of the power cord. As illustrated in FIG. 2, the electronic module features a housing 22 which defines a chamber 24 within which is positioned electronic circuitry 26. In this embodiment, and in the additional embodiments described below, the electronic circuitry may be a radio frequency identification tag (RFID) tag, communication device, gas sensor, dust sensor or any other electronic device that may be useful if carried by a miner or other worker. In this embodiment and the embodiments described below, the housing 22 preferably is molded or otherwise constructed out of plastic and features an opening that is sealed with a gasketed cover once the electronic circuitry 26 is positioned within chamber 24. Other durable materials may be used instead for constructing the housing. The electronic circuitry 26 receives power from the power cord segments 18*a* and 18*b* and also allows power to travel to the cap lamp.

Figure 3:
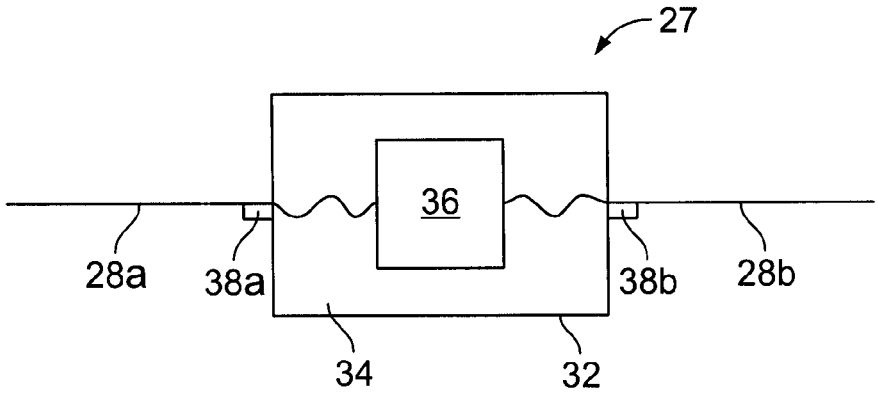
FIG. 3 is a schematic of a second embodiment of the electronic module of the present invention.

A second embodiment of the electronic module is presented in FIG. 3. Like the embodiment of FIGS. 1 and 2, this electronic module 27 uses a power cord featuring segments 28*a* and 28*b* and includes a housing 32 defining a cavity 34 within which electronic circuitry 36 is positioned. As in the case of the embodiment of FIGS. 1 and 2, the electronic circuitry 36 is powered by the power cord segments and allows power to travel to the cap lamp. In the embodiment of FIG. 3, however, the segments 28*a* and 28*b* are removably connected to the housing via connectors 38*a* and 38*b*, respectively. As a result, the electronic module may be removed from the power cord and the two segments 28*a* and 28*b* fastened together via connectors 38*a* and 38*b*. As a result, the electronic module may be removed from being in circuit between the cap lamp and the battery pack.

Figure 4:
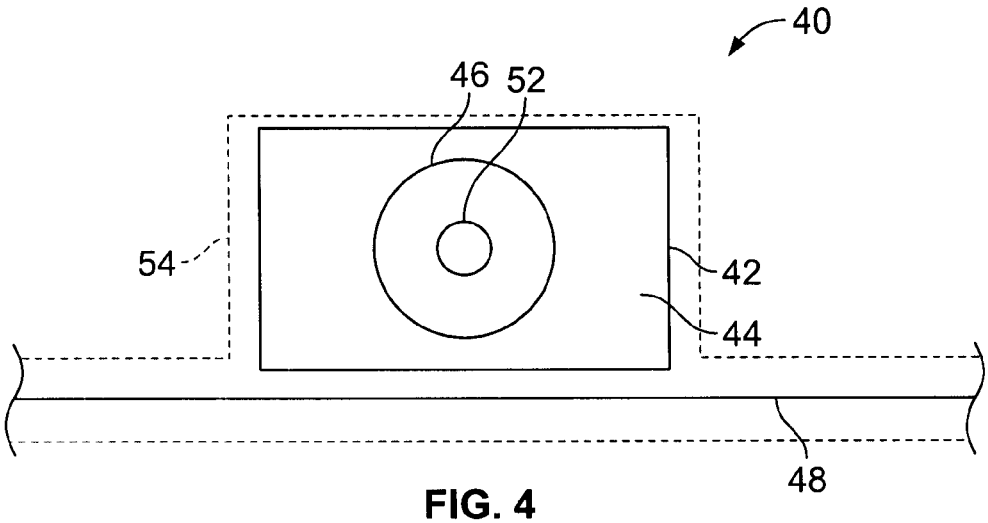
FIG. 4 is a schematic of an on-board battery-powered embodiment of the electronic module of the present invention.
Figure 5:
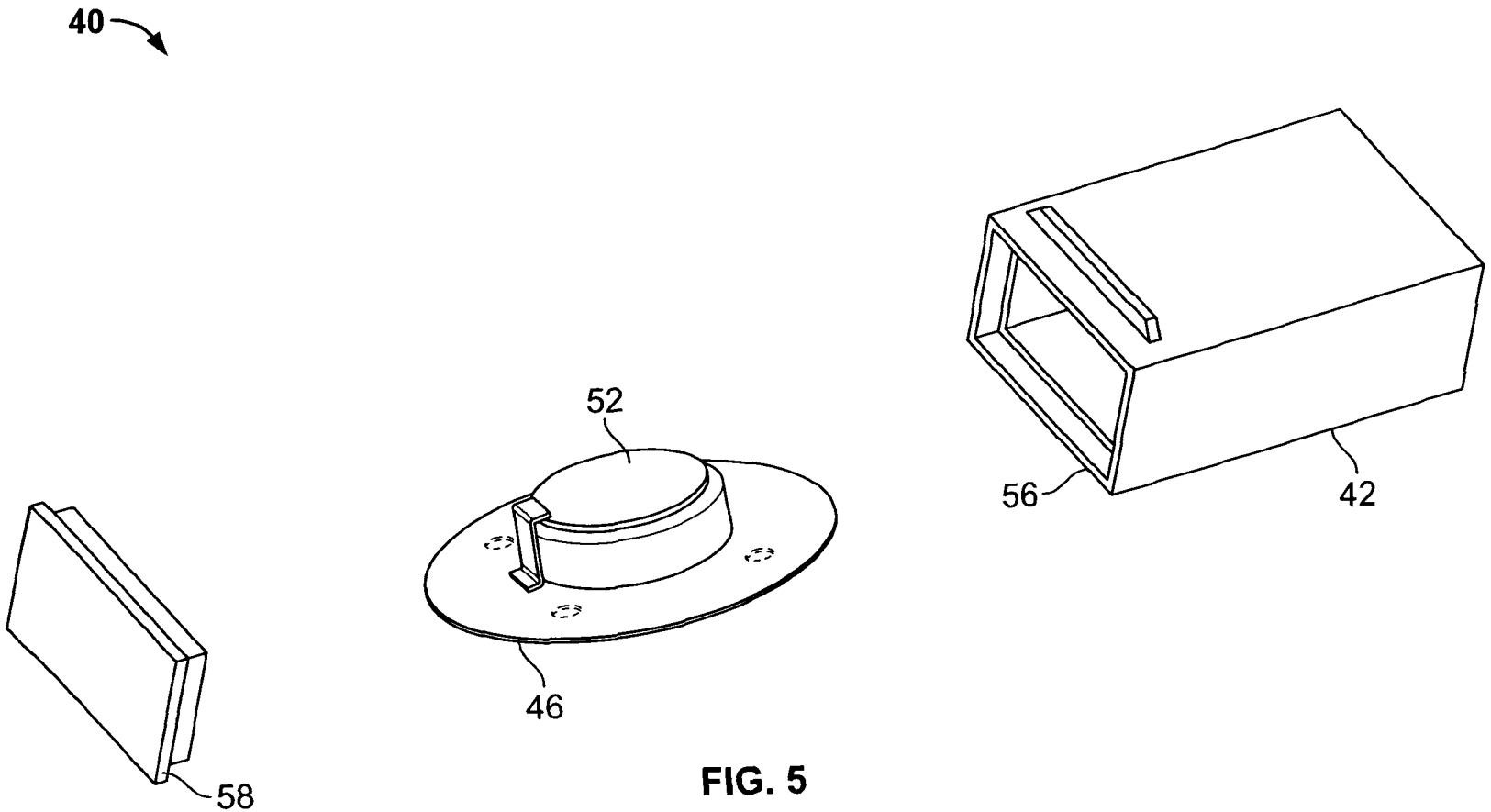
FIG. 5 is an exploded perspective view of the electronic module of FIG. 4.

An embodiment of the electronic module that is powered by an on-board battery is illustrated in FIGS. 4 and 5. With reference to FIG. 4, the electronic module 40 features a housing 42 which defines a chamber 44 within which is positioned electronic circuitry 46. In the case of this embodiment, however, the power cord 48 does not power the electronic module. Instead, the electronic module features an on-board battery 52 which powers the electronic circuitry. The electronic module, never-the-less, is still positioned on the power cord 48. A protective coating of rubber, plastic or some other flexible, protective material is indicated in phantom at 54 in FIG. 4 covers the electronic module 40 and power cord 48. This same coating is present in the embodiment of FIGS. 1 and 2 and is visible in FIG. 1.

An exploded perspective view of the electronic module, which is indicated in general at 42, is provided in FIG. 5. As in previous embodiments, the housing 42 preferably is molded or otherwise constructed out of plastic and features an opening 56 that is sealed with a gasketed cover 58 once the electronic circuitry 46 and battery 52 are positioned within the housing chamber. Once the housing and cover are assembled, with the electronic circuitry and battery positioned inside, the electronic module may be covered with the protective coating 54 of FIG. 4.

As noted previously, the construction described with regard to FIGS. 4 and 5 may be used with the embodiments of FIGS. 1-3

While the electronic circuitry may be a powered or self-powered electronic device, such as a printed circuit board with or without a coin cell battery, the electronic module may act as a mounting point (like a docking station) and/or power source, for a variety of interchangeable electronic devices. This is true whether the electronic module includes batteries or not. In the case of no batteries, the "docked" removable electronic device could receive power from the power cord.

While the preferred embodiments of the invention have been shown and described, it will be apparent to those skilled in the art that changes and modifications may be made therein without departing from the spirit of the invention, the scope of which is defined by the appended claims.

What is claimed is:

1. A cap lamp system for a mining helmet comprising:

a) a battery pack including a battery pack housing;

b) a cap lamp housing containing a cap lamp bulb;

c) a power cord having a first segment connected to the battery pack housing and a second segment connected to the cap lamp housing, said first and second power cord segments providing power to the cap lamp bulb from the battery pack;

d) an electronic module including an electronic module housing defining a chamber and electronic circuitry positioned within the chamber of the electronic module housing; and e) said first and second power cord segments connected to the electronic module, with at least one of said first power cord segment or said second power cord segment being removably connected to said electronic module so that the electronic module housing is removably positioned in circuit with the first and second segments of the power cord with the electronic module housing spaced from and positioned between the battery pack housing and the cap lamp housing.

2. The cap lamp system of claim 1 wherein the electronic module receives power from the battery pack.

3. The cap lamp system of claim 2 wherein the electronic circuitry of the electronic module includes a battery that powers the module.

4. The cap lamp system of claim 1 wherein the electronic circuitry is an electronic communications tag.

5. The cap lamp system of claim 4 wherein the electronic communications tag is a Radio Frequency identification tag.

6. The cap lamp system of claim 1 wherein the electronic circuitry is a gas sensor.

7. The cap lamp system of claim 1 wherein the electronic circuitry is a dust sensor.

8. The cap lamp system of claim 1 wherein the module features a coating.

9. The cap lamp system of claim 8 wherein the coating is rubber.

10. A cap lamp system for a mining helmet comprising:

a) a battery pack including a battery pack housing;

b) a cap lamp housing containing a cap lamp bulb;

c) a power cord having a first segment connected to the battery pack housing and a second segment connected to the cap lamp housing, said first and second power cord segments providing power to the cap lamp bulb from the battery pack;

d) an electronic module including an electronic module housing defining a chamber and electronic circuitry positioned within the chamber of the electronic module housing; and e) said first and second power cord segments connected to the electronic module with at least one of said first power cord segment or said second power cord segment being removably connected to said electronic module so that the electronic module housing is removably positioned between and spaced from the battery pack housing and the cap lamp housing.

11. The cap lamp system of claim 10 wherein the electronic module receives power from the battery pack.

12. The cap lamp system of claim 11 wherein the electronic circuitry of the electronic module includes a battery that provides power to the module.

13. The cap lamp system of claim 10 wherein the electronic circuitry is an electronic communications tag.

14. The cap lamp system of claim 13 wherein the electronic communications tag is a Radio Frequency identification tag.

15. The cap lamp system of claim 10 wherein the electronic circuitry is a gas sensor.

16. The cap lamp system of claim 10 wherein the electronic circuitry is a dust sensor.

17. The cap lamp system of claim 10 wherein the module features a coating.

18. The cap lamp system of claim 17 wherein the coating is rubber.

19. A portable lighting system comprising:

a) a battery pack including a battery pack housing;

b) a lamp housing containing a lamp bulb;

c) a power cord having a first segment connected to the battery pack housing and a second segment connected to the lamp housing, said first and second power cord segments providing power to the lamp from the battery pack;

d) an electronic module including an electronic module housing defining a chamber and electronic circuitry positioned within the chamber of the electronic module housing; and e) said first and second power cord segments connected to the electronic module with at least one of said first power cord segment or said second power cord segment being removably connected to said electronic module so that the electronic module housing is removably positioned between and spaced from the battery pack housing and the lamp housing.

20. The portable lighting system of claim 19 wherein the electronic module receives power from the battery pack.

21. The portable lighting system of claim 19 wherein the electronic circuitry of the electronic module includes a battery that provides power to the module.

22. The portable lighting system of claim 19 wherein the electronic circuitry is an electronic communications tag.

23. The portable lighting system of claim 22 wherein the electronic communications tag is a Radio Frequency identification tag.

24. The portable lighting system of claim 19 wherein the electronic circuitry is a gas sensor.

25. The portable lighting system of claim 19 wherein the electronic circuitry is a dust sensor.

26. The portable lighting system of claim 19 wherein the module features a coating.

27. The portable lighting system of claim 26 wherein the coating is rubber.

28. A power transfer device for a portable lighting system having a battery pack with a battery pack housing and a portable lamp with a portable lamp housing, the power transfer device comprising:

a) an electronic module including a housing defining a chamber and electronic circuitry positioned within the chamber of the housing;

b) a first power cord segment adapted to be attached to the battery pack and a second power cord segment adapted to be attached to the portable lamp; and c) said first and second power cord segments connected to the electronic module, with at least one of said first power cord segment or said second power cord segment being removably connected to said electronic module so that the electronic module housing may be removably positioned in circuit with the first and second segments of the power cord with the electronic module housing spaced from and positioned between the battery pack housing and theportable lamp housing.

29. The power transfer device of claim 28 wherein the electronic module receives power from the battery pack.

30. The power transfer device of claim 28 wherein the electronic circuitry of the electronic module includes a battery that provides power to the module.

31. The power transfer device of claim 28 wherein the electronic circuitry is an electronic communications tag.

32. The power transfer device of claim 31 wherein the electronic communications tag is a Radio Frequency identification tag.

33. The power transfer device of claim 28 wherein the electronic circuitry is a gas sensor.

34. The power transfer device of claim 28 wherein the electronic circuitry is a dust sensor.

35. The power transfer device of claim 28 wherein the module features a rubber coating.

36. The cap lamp system of claim 1 wherein both of said first and second power cord segments are removably connected to said electronic module.

37. The cap lamp system of claim 1 wherein the first power cord segment features a distal end having a connector that is removably connected to the electronic module, where the first power cord segment connector is adapted to be removably placed in electrical communication with the cap lamp bulb when the electronic module is removed from being in circuit with the first and second segments of the power cord.

38. The cap lamp system of claim 37 wherein the second power cord segment also features a distal end having a connector where the first and second power cord segment connectors are adapted to be fastened together when the electronic module is removed from being in circuit with the first and second segments of the power cord.

39. The cap lamp system of claim 1 wherein the second power cord segment features a distal end having a connector that is removably connected to the electronic module, where the second power cord segment connector is adapted to be removably placed in electrical communication with the battery pack when the electronic module is removed from being in circuit with the first and second segments of the power cord.

40. The cap lamp system of claim 39 wherein the first power cord segment also features a distal end having a connector where the first and second power cord segment connectors are adapted to be fastened together when the electronic module is removed from being in circuit with the first and second segments of the power cord.

* * * * *